United States Patent [19]

Yaffe

[11] 4,124,514

[45] Nov. 7, 1978

[54] SYNTHETIC AIRCRAFT TURBINE LUBRICATING OIL COMPOSITIONS

[75] Inventor: Roberta Yaffe, Glenham, N.Y.

[73] Assignee: Texaco Inc., New York, N.Y.

[21] Appl. No.: 810,719

[22] Filed: Jun. 28, 1977

[51] Int. Cl.[2] ..... C10M 1/24; C10M 1/48

[52] U.S. Cl. ..... 252/46.7; 252/45; 252/56 S

[58] Field of Search ..... 252/46.7, 45, 56 S

[56] References Cited

U.S. PATENT DOCUMENTS

| | | | |
|---|---|---|---|
| 2,528,782 | 11/1950 | Reiff et al. | 252/45 |
| 2,732,346 | 1/1956 | Jones et al. | 252/45 |
| 3,476,685 | 11/1969 | Oberender et al. | 252/46.7 |
| 3,850,024 | 11/1974 | Nebzydoski et al. | 252/46.7 |

*Primary Examiner*—Delbert E. Gantz
*Assistant Examiner*—Andrew Metz
*Attorney, Agent, or Firm*—Thomas H. Whaley; Carl G. Ries; James F. Young

[57] ABSTRACT

Synthetic lubricating oil composition having improved oxidation stability comprising a major portion of an aliphatic ester base oil having lubricating properties formed by the reaction of pentaerythritol and an organic monocarboxylic acid and containing an alkylphenyl or alkaryl phenylnaphthylamine, a dialkyldiphenylamine, a polyhydroxy anthraquinone, a hydrocarbyl phosphate ester and an aromatic substituted thiophene.

9 Claims, No Drawings

SYNTHETIC AIRCRAFT TURBINE LUBRICATING OIL COMPOSITIONS

BACKGROUND OF THE INVENTION

Field of the Invention

This invention is concerned with a pentaerythritol ester base lubricating oil composition for a gas turbine engine. Gas turbine engines are operated under a wide range of temperature conditions. The lubricant must be fluid at extremely low temperatures and at the same time retain is lubricating properties in an engine which produces internal operating temperatures at 450°-550° F. or above. The lubricant is subjected to severe oxidation stresses under the high running temperatures encountered in such engines.

Ester base lubricating oil compositions prepared from pentaerythritol and a mixture of fatty acids and containing selected additive combinations are well known. These lubricants are functional over a wide temperature range and exhibit good thermal and oxidative stability. The search for a still more effective, long lived ester base lubricant composition, however, is a major goal of lubricant manufacturers. In addition, more advanced gas turbine engines currently being developed and tested will put higher stresses on the lubricant composition and are projected to require improved lubricant compositions.

SUMMARY OF THE INVENTION

The synthetic lubricating oil composition of the invention comprises a major portion of an aliphatic ester base oil containing an alkylphenyl or alkarylphenyl napthylamine, a dialkyldiphenylamine, a polyhydroxy anthraquinone, a hydrocarbyl phosphate ester and an aromatic substituted thiophene. More specifically, the lubricating oil composition of the invention comprises a major portion of an aliphatic ester base oil formed from the reaction of pentaerythritol and an organic monocarboxylic acid having from about 2 to 18 carbon atoms per molecule containing:

(a) from about 0.3 to 5 percent by weight of the lubricating oil composition of alkyl or alkaryl derivatives of phenyl naphthylamines in which the alkyl radical contain from 4 to 12 carbon atoms, and the alkaryl radical has from 7 to 12 carbon atoms, (b) from about 0.3 to 5 percent by weight of a dialkyldiphenylamine in which the alkyl radicals contain from 4 to 12 carbon atoms, (c) from about 0.001 to 1 percent by weight of a polyhydroxyanthraquinone, (d) from about 0.25 to 10 percent by weight of a hydrocarbyl phosphate ester in which said hydrocarbyl radical contains an aryl ring and has from about 6 to 18 carbon atoms, and (e) from about 0.1 to 2.5 percent by weight of an aromatic substituted thiophene.

The lubricating oil composition of the invention provides substantial improvements in oxidative stability, particularly excellent control of acidity and viscosity increase under severe oxidizing conditions.

DETAILED DESCRIPTION

The base fluid component of the composition of the invention is an ester-base fluid prepared from pentaerythritol and a mixture of hydrocarbyl monocarboxylic acids. Polypentaerythritols, such as dipentaerythritol, tripentaerythritol and tetrapentaerythritol can also be employed in the reaction to prepare the base oil.

The hydrocarbon monocarboxylic acids which are used to form the ester-base fluid include the straight-chain and branched-chain aliphatic acids, as well as mixtures of these acids. The acids employed have from about 2 to 18 carbon atoms per molecule, and preferably from about 5 to 10 carbon atoms. Examples of suitable acids are acetic, propionic, butyric, valeric, isovaleric, caproic, decanoic, dodecanoic, tertiary-butylacetic and 2-ethylhexanoic acid, including mixtures.

In general, the acids are reacted in proportions leading to a completely esterified pentaerythritol or polypentaerythritol with the preferred ester bases being the pentaerythritol tetraesters. Examples of such commercially available tetraesters include pentaerythritol tetracaproate, which is prepared from purified pentaerythritol and crude caproic acid containing other $C_{5-10}$ monobasic acids. Another suitable tetraester is prepared from a technical grade pentaerythritol and a mixture of acids comprising 38 percent valeric, 13 percent 2-methyl pentanoic, 32 percent octanoic and 17 percent pelargonic acids, by weight.

The ester base fluid comprises the major portion of the fully formulated synthetic ester base lubricating oil composition. In general, this ester base fluid is present in concentrations from about 90 to 98 percent of the composition, by weight.

The essential alkyl or alkaryl phenyl naphthylamine component of the invention is represented by the formula:

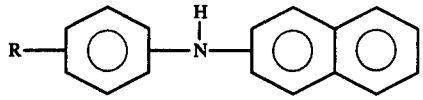

in which R is an alkyl radical containing from about 4 to 12 carbon atoms or an alkaryl radical containing from 7 to 12 carbon atoms. This radical can be a straight or branched chain alkyl radical with the tertiary alkyl structure being preferred or it can be an alkylaryl radical.

Specific effective compounds of this class include N-(para-tertiary-octylphenyl)-$\alpha$ or $\beta$-naphthylamine, N-(4-cumylphenyl)$\alpha$ or $\beta$-naphthylamine, and the corresponding para-tertiary-dodecylphenyl and para-tertiary-butylphenyl alpha- and beta-naphthylamines. The preferred naphthylamines are those in which R is a tertiary alkyl radical having from 6 to 10 carbon atoms therein. The preferred concentration of this component is from about 0.5 to 2.5 percent by weight.

Another essential component of the lubricating oil composition of the invention is a dialkyldiphenylamine. These compounds are represented by the formula:

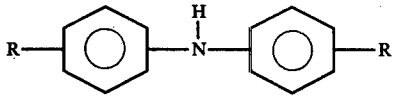

in which R is an alkyl radical having from about 4 to 12 carbon atoms. Suitable alkylamines include dioctyldiphenylamine, didecyldiphenylamine, didodecyldiphenylamine, dihexyldiphenylamine and similar compounds. Dioctyldiphenylamine is the preferred compound and the preferred concentration is from 0.5 to 2.0 percent by weight.

The essential metal deactivator of the lubricating oil composition of the invention is a polyhydroxyanthraquinone. Suitable compounds in this class are the dihydroxyanthraquinones such as 1,4-dihydroxyanthraquinone and 1,5-dihydroxyanthraquinone and the higher polyhydroxyanthraquinones such as 1,2,5,8-tetrahydroxyanthraquinone. The preferred concentration of this component is from about 0.01 to 0.5 weight percent.

Another component of the lubricating oil composition of the invention is a hydrocarbyl phosphate ester, more specifically a trihydrocarbyl phosphate in which the hydrocarbyl radical is an aryl or alkaryl radical or mixture thereof containing from 6 to 18 carbon atoms and preferably from 6 to 12 carbon atoms. Effective specific compounds include tricresylphosphate, cresyl diphenylphosphate and triphenylphosphate. These compounds are preferably in the lubricating oil composition in a concentration ranging from about 0.5 to 5 wt. %.

Another essential component of the lubricating oil composition is an aromatic substituted thiophene compound, specifically, dibenzothiopene. This substituted thiophene is present in the lubricating oil composition in an amount of from about 0.1 to about 2.5%, preferably in a concentration range of from about 0.3 to about 1%, by weight.

The novel lubricating oil compositions of the present invention exhibit improved oxidation stability particularly excellent control of acidity and viscosity increase under severe oxidizing conditions. These results are completely unexpected since the sulfur atom of the additive dibenzothiophene is fully aromatized and inactive. These results are further surprising since the related compound diphenyl sulfide imparts no added oxidative stability to the lubricating oil composition.

The ester base oil employed in preparing the lubricating oil composition of the invention comprised pentaerythritol containing a minor amount of dipentaerythritol esterified with a mixture of fatty acids. It consisted of technical grade pentaerythritol ester made from a mixture of carboxylic acid consisting of (mole %):

| | |
|---|---|
| i - $C_5$ | 8 ± 3% |
| n - $C_5$ | 23 ± 5% |
| n - $C_6$ | 20 ± 5% |
| n - $C_7$ | 27 ± 5% |
| n - $C_8$ | 7 ± 3% |
| n - $C_9$ | 16 ± 3% |

This ester base oil had the following properties:

| | |
|---|---|
| Viscosity, cs at 210° F | (5.01) |
| Viscosity, cs at 100° F | (25.6) |

-continued

| | |
|---|---|
| Viscosity, cs at −40° F | (7005) |
| Viscosity Index | (140) |
| Flash, ° F | (515) |

The above ester oil was blended with all of the prescribed essential additives with the exception of the dibenzothiophene to form a Base Fluid. Based on a fully formulated lubricant composition, the Base Fluid consisted of about 95.4 weight percent of the ester base oil described above with 1.5 weight percent of t-octyl-phenyl-α-naphthylamine, 1.0 weight percent of dioctyldiphenylamine, 2.0 weight percent of tricresylphosphate and 0.1 weight percent of quinizarin.

The oxidation-stability of the lubricant of the invention as compared to the Base Fluid was determined in the Rolls Royce (RR 1001) Oxidation Test. (D. Eng. R.D. 2497 Supplement Method No. 12). The results are set forth in the following Table.

TABLE

| | ROLLS ROYCE (RR 1001) OXIDATION TEST 260° C./6 HRS. | | | | | | | |
|---|---|---|---|---|---|---|---|---|
| | Base Fluid | Base Fluid + 0.1 Wt. % Additive "A" | Base Fluid | Base Fluid + 0.5 Wt. % Additive "B" | Base Fluid | Base Fluid + 0.1 Wt. % Additive "A" | Base Fluid | Base Fluid + 0.5 Wt. % Additive "B" |
| % Viscosity Change at 100° F | 96.0 | 82.5 | 80.6 | 44.0 | 96.7 | 99.4 | 97.0 | 108.0 |
| Total Acid Number Change | 4.90 | 4.92 | 5.28 | 3.26 | 4.09 | 4.09 | 3.68 | 3.67 |

ADDITIVE "A" - Dibenzothiophene
ADDITIVE "B" - Diphenyl Sulfide

The data in the Table above show that the oxidative stability of the lubricating oil compositions of the present invention is significantly improved in comparison to the Base Fluid or to the Base Fluid containing diphenyl sulfide.

In comparison to the Base Fluid, the composition of the invention showed a reduction in Viscosity Increase of about 14% at 0.1% wt. concentration and 45.4% at 0.5 wt. % concentration. The composition containing dephenyl sulfide at 0.1 wt. % concentration showed an increase in viscosity of 2.8% and 11% at 0.5 wt. %.

At 0.5 wt. % concentration, the dibenzothiophene composition of the invention showed a 38.3% decrease in Total Acid Number Change in comparison to the 0.27% decrease occurring with the diphenyl sulfide composition.

The lubricating oil compositions containing dibenzothiophene shown in the Table were further evaluated in the Pratt and Whitney Aircraft Specification PWA-521B Oxidation-Corrosion Test 425° F./48 HRS. and the Navy MIL-L-23699B Specification 400° F./72 HRS. Oxidation Corrosion Test and were found to satisfy completely these specification requirements.

Obviously, many modifications and variations of the invention as hereinbefore set forth may be made without departing from the spirit and scope thereof and therefore only such limitations should be imposed as are indicated in the appended claims.

I claim:

1. A synthetic lubricating oil composition comprising a major portion of an aliphatic ester base oil having lubricating properties formed from the reaction of pentaerythritol or a polypentaerythritol or trimethylolpropane and an organic monocarboxylic acid having from about 2 to 18 carbon atoms per molecule and containing:

(a) from about 0.3 to 5 percent by weight of the lubricating oil composition of an alkyl or alkaryl phenyl naphthylamine in which the alkyl radical has from 4 to 12 carbon atoms, and the alkaryl radical has from 7 to 12 carbon atoms, (b) from about 0.3 to 5 percent by weight of a dialkyldiphenylamine in which the alkyl radicals have from 4 to 12 carbon atoms, (c) from about 0.001 to 1 percent by weight of a polyhydroxy-substituted anthraquinone, (d) from about 0.25 to 10 percent by weight of a hydrocarbyl phosphate ester in which said hydrocarbyl radical contains an aryl ring and contains from about 6 to 18 carbon atoms, and (e) from about 0.1 to about 2.5 percent by weight of dibenzothiophene.

2. A lubricating oil composition as claimed in claim 1 containing from about 0.3 to about 1 percent by weight of the dibenzothiophene.

3. A lubricating oil composition as claimed in claim 1 wherein the naphthylamine is octylphenyl-alpha-or-beta-naphthylamine.

4. A lubricating oil composition as claimed in claim 1 containing from about 0.5 to 2.0 percent of a dialkyldiphenylamine, by weight.

5. A lubricating oil composition as claimed in claim 4, wherein the dialkyldiphenylamine is a dioctyldiphenylamine.

6. A lubricating oil composition as claimed in claim 1 containing from about 0.01 to 0.5 percent of said polyhydroxy-substituted anthraquinone, by weight.

7. A lubricating oil composition as claimed in claim 6 wherein the polyhydroxy-substituted anthraquinone is 1,4-dihydroxyanthraquinone.

8. A lubricating oil composition as claimed in claim 1 containing from about 0.5 to 5 percent of a hydrocarbyl phosphate ester, by weight.

9. A lubricating oil composition as claimed in claim 1 wherein the aliphatic ester base oil is present in a concentration of from about 90 to 98 percent of the composition, by weight.

* * * * *